US010401777B2

(12) United States Patent
Kanno

(10) Patent No.: US 10,401,777 B2
(45) Date of Patent: Sep. 3, 2019

(54) IMAGE FORMING APPARATUS WITH IMAGE TIMING SIGNAL ADJUSTMENT

(71) Applicant: CANON KABUSHIKI KAISHA, Tokyo (JP)

(72) Inventor: Naoki Kanno, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/489,120

(22) Filed: Apr. 17, 2017

(65) Prior Publication Data

US 2017/0219983 A1 Aug. 3, 2017

Related U.S. Application Data

(63) Continuation of application No. 14/604,897, filed on Jan. 26, 2015, now Pat. No. 10,120,319.

(30) Foreign Application Priority Data

Jan. 31, 2014 (JP) ..... 2014-017367

(51) Int. Cl.
*G03G 15/00* (2006.01)
*G03G 15/043* (2006.01)

(52) U.S. Cl.
CPC ..... *G03G 15/6564* (2013.01); *G03G 15/043* (2013.01); *G03G 15/505* (2013.01);
(Continued)

(58) Field of Classification Search
CPC ..... G03G 15/6594; G03G 2215/00447; G03G 2215/00556; G03G 2215/0059; G03G 15/6564
(Continued)

(56) References Cited

U.S. PATENT DOCUMENTS 6,125,258 A 9/2000 Umetani et al. ..... 399/394
8,060,003 B2 11/2011 Yoshizawa ..... 399/396
(Continued)

FOREIGN PATENT DOCUMENTS

JP H06-218979 8/1994
JP 06263293 A * 9/1994
(Continued)

OTHER PUBLICATIONS

Endo (JP 2012-113202 A), Jun. 2012, JPO Computer Translation.*
(Continued)

*Primary Examiner* — Erika J Villaluna
(74) *Attorney, Agent, or Firm* — Venable LLP

(57) ABSTRACT

The image forming apparatus includes a control unit for converting image information into an image signal and output the image signal with reference to a timing signal, a sheet feeding control unit for feeding a recording material, an image forming unit for forming the image on a photosensitive drum based on the image signal output from the control unit, a transmission unit for transmitting a length of the image corresponding to a length of an output period of the image signal, an automatic sheet length detection mechanism for acquiring a length of the recording material in a conveyance direction thereof, and an image control unit for controlling a time interval at which the timing signal is output based on the size of the image and the size of the recording material.

6 Claims, 9 Drawing Sheets

(52) U.S. Cl.
CPC ..... *G03G 15/5095* (2013.01); *G03G 15/6594* (2013.01); *G03G 15/5029* (2013.01); *G03G 2215/00126* (2013.01); *G03G 2215/00599* (2013.01)

(58) Field of Classification Search
USPC ..... 399/45, 86, 156; 3/45, 86, 156
See application file for complete search history.

(56) References Cited

U.S. PATENT DOCUMENTS

| | | | | |
|---|---|---|---|---|
| 2011/0220557 | A1 | 9/2011 | Sasaki et al. | G03G 15/6538 |
| 2013/0155428 | A1 | 6/2013 | Mizuno | G06K 15/02 |
| 2014/0118763 | A1 | 5/2014 | Minakuchi | H04N 1/00763 |

FOREIGN PATENT DOCUMENTS

| | | |
|---|---|---|
| JP | H11-184271 | 7/1999 |
| JP | 2001-215847 | 8/2001 |
| JP | 2002-196597 | 7/2002 |
| JP | 2008-122935 | 5/2008 |
| JP | 2012-113202 | 6/2012 |
| JP | 2012-212173 | 11/2012 |

OTHER PUBLICATIONS

Yoshizawa (JP 2012-212173 A), Nov. 2012, JPO Computer Translation.*
Office Action dated Nov. 8, 2016 in counterpart Japan Application No. 2014-017367, together with machine-generated translation thereof.
Office Action dated Apr. 4, 2017 in counterpart Japan Application No. 2014-017367, together with machine-generated translation thereof.

* cited by examiner

IMAGE FORMING APPARATUS WITH IMAGE TIMING SIGNAL ADJUSTMENT

This application is a continuation of application Ser. No. 14/604,897 filed Jan. 26, 2015, currently pending; and claims priority under 35 U.S.C. § 119 to Japan Application 2014-017367 filed in Japan on Jan. 31, 2014; and the contents of all of which are incorporated herein by reference as if set forth in full.

BACKGROUND OF THE INVENTION

Field of the Invention

The present invention relates to an image forming apparatus that uses an electrophotographic process or the like.

Description of the Related Art

Hitherto, as an electrophotographic image forming apparatus, there is known an image forming apparatus having a configuration that uses an intermediate transfer member. In a primary transfer step, a toner image formed on a photosensitive drum serving as an image bearing member is transferred onto the intermediate transfer member (hereinafter referred to as "intermediate transfer belt"). After that, the primary transfer step is repeatedly executed for toner images formed in respective image forming stations for yellow (Y), magenta (M), cyan (C), and black (Bk), to thereby form toner images having a plurality of colors on the intermediate transfer belt. Subsequently, in a secondary transfer step, the toner images having the plurality of colors formed on the intermediate transfer belt are transferred onto a surface of a recording material such as paper fed from a sheet feeding unit. The toner images transferred onto the recording material are then fixed onto the recording material by a fixing unit, and a color image is formed thereon.

In such an image forming apparatus, a control unit receives print data from an external apparatus such as a host computer, and expands bitmap data based on the received print data. Then, after finishing expanding the bitmap data, the control unit outputs the expanded bitmap data to an engine unit configured to control image formation as video data. The control unit includes an expansion circuit for each image forming station controlled by the engine unit in order to transmit the video data to each image forming station. The control unit transmits the video data of a corresponding color to each image forming station in accordance with an image writing signal (hereinafter referred to as "/TOP signal") output from the engine unit, to thereby perform the image formation.

Further, the image forming apparatus may be instructed to perform a printing operation for a sheet having an indefinite size by the external apparatus such as a host computer. When instructed to perform the printing operation for the indefinite size, the engine unit performs appropriate printing in accordance with the size of the sheet no matter which size (length of the sheet in a conveyance direction) the sheet set in the sheet feeding unit has. In such an image forming apparatus, when the size of the sheet placed in the sheet feeding unit is unknown, the image formation is performed by determining an image formation interval serving as a time interval at which the /TOP signal is output from the engine unit to the control unit with reference to the maximum size of the sheet to be placed in the sheet feeding unit. Then, the image formation is performed by changing the image formation interval in accordance with the size of the sheet so that a distance between the sheets becomes a predetermined interval at a timing at which the size of the sheet is determined. A proposal to suppress deterioration in productivity by improving throughput in this manner is disclosed in, for example, Japanese Patent Application Laid-Open No. 2008-122935.

According to the above-mentioned image forming apparatus, an output interval of the /TOP signal is determined based on the size of the sheet. Therefore, when the size of the image formed by the control unit (length of the image in the conveyance direction) is larger than the size of the sheet placed in the sheet feeding unit, there may be an overlap between periods during which video signals are output. That is, while the control unit is outputting the video signal of the image corresponding to a leading sheet, the /TOP signal corresponding to the following sheet may be received from the engine unit. As a result, there is a problem in that the printing operation cannot be normally performed due to the overlap between the periods during which the video signal of the image corresponding to the leading sheet and the video signal of the image corresponding to the following sheet are output.

SUMMARY OF THE INVENTION

The present invention has been made in view of the above-mentioned circumstances, and an object thereof is to perform normal image formation without an overlap between output periods of video signals, to thereby suppress deterioration in productivity.

According to one embodiment of the present invention, the purpose of the present invention is to provide an image forming apparatus including an output unit configured to convert image information into an image signal and output the image signal with reference to a timing signal, an image forming unit configured to form an image on an image bearing member based on the image signal output from the output unit, a transmission unit configured to transmit a length of the image corresponding to a length of an output period of the image signal, a feeding unit configured to feed a recording material, an acquiring unit configured to acquire a length of the recording material fed by the feeding unit in a conveyance direction of the recording material, and a control unit configured to control a time interval at which the timing signal is output to the output unit based on the length of the image transmitted by the transmission unit and the length of the recording material acquired by the acquiring unit.

Further features of the present invention will become apparent from the following description of exemplary embodiments with reference to the attached drawings.

DESCRIPTION OF THE EMBODIMENTS

Now, embodiments of the present invention are described in detail with reference to the accompanying drawings.

[First Embodiment]

[Outline of Image Forming Apparatus]

Figure 1A:
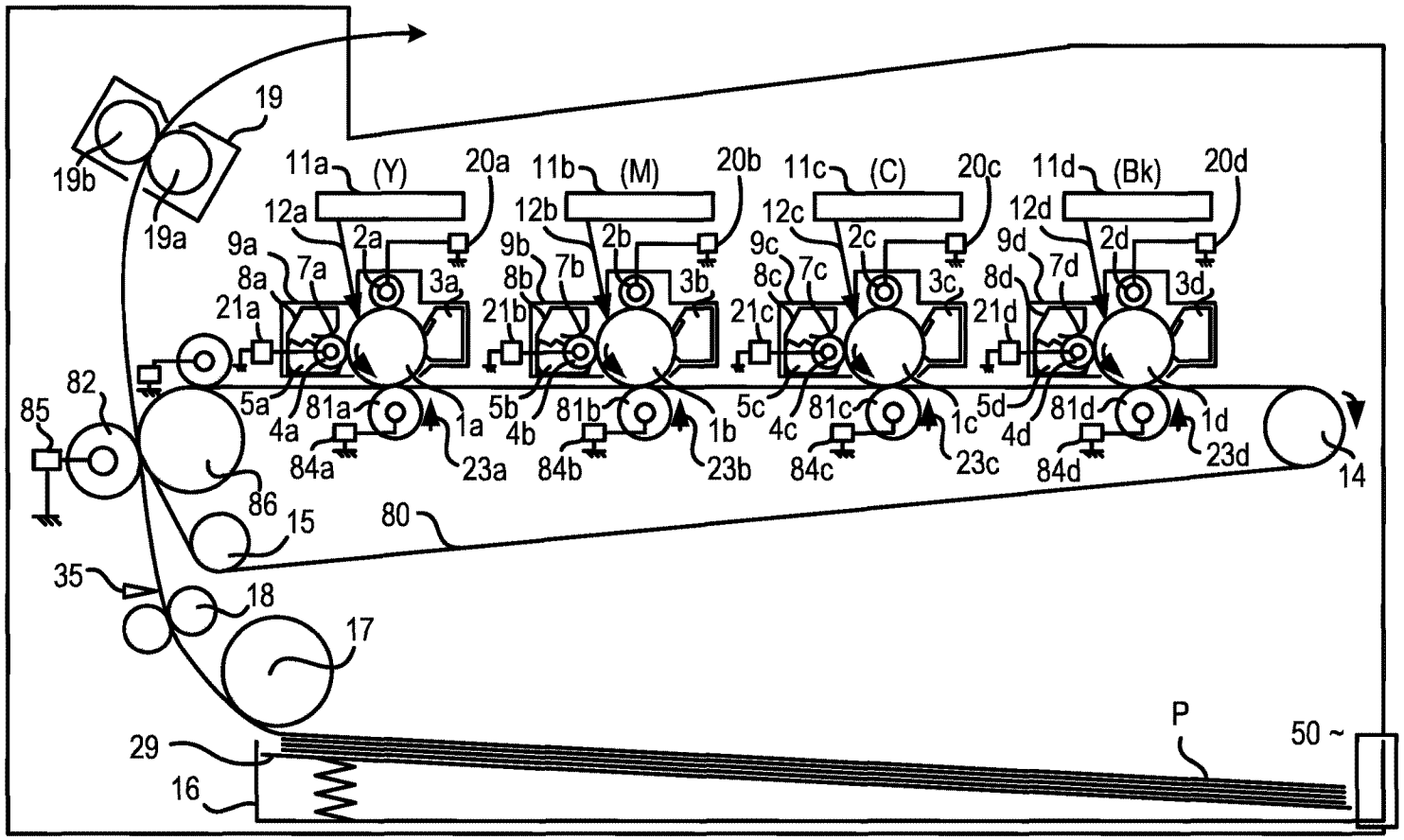
FIG. 1A is an overall configuration diagram of an image forming apparatus according to first to third embodiments of the present invention.

FIG. 1A illustrates an overall configuration of a laser printer as an example of an image forming apparatus according to a first embodiment of the present invention. The image forming apparatus illustrated in FIG. 1A includes four image forming stations, and the respective image forming stations include toner of yellow (Y), magenta (M), cyan (C), and black (Bk) in order from the left in FIG. 1A. Further, "a", "b", "c", and "d" at the end of the reference numerals in the drawings mean yellow (Y), magenta (M), cyan (C), and black (Bk), respectively. The respective image forming stations have the same configuration, and in the following description, the symbols of "a" to "d" are omitted unless otherwise necessary. Further, in this embodiment, a sheet is used as a recording material on which an image is to be formed.

(Image Forming Unit)

In each image forming station, a photosensitive drum 1 serving as an image bearing member is driven by a drive motor (not shown), to be rotationally driven counterclockwise (arrowed direction in FIG. 1A). A charge roller 2 serving as a charge unit is brought into abutment against the photosensitive drum 1, to uniformly charge a surface of the photosensitive drum 1 while being rotated in accordance with rotation of the photosensitive drum 1. A direct current voltage or a voltage having an alternate current voltage superposed thereon is applied to the charge roller 2, and the photosensitive drum 1 is charged via an abutment nip portion between the charge roller 2 and the surface of the photosensitive drum 1. A scanning unit 11 serving as an exposure unit is formed of an LED array or a scanner unit configured to scan a laser beam by a rotary polygonal mirror, and applies a scanning beam 12 modulated based on a video signal (image signal) onto the photosensitive drum 1, to thereby form an electrostatic latent image. A developing unit 8 serving as a developing unit is formed of a developing roller 4 brought into abutment against the photosensitive drum 1, developer (toner) 5, and a developer application blade 7. The electrostatic latent image formed on the photosensitive drum 1 is developed by the toner to form a toner image. A cleaning unit 3 removes the toner remaining on the photosensitive drum 1 that has not been transferred onto an intermediate transfer belt 80 to be described later. A process cartridge 9 incorporates the photosensitive drum 1, the charge roller 2, the cleaning unit 3, and the developing unit 8, and is an integral cartridge that is removably mounted to the image forming apparatus. Further, the charge roller 2 and the developing roller 4 are connected to a charging voltage source 20 serving as a voltage supply unit for the charge roller 2 and a developing voltage source 21 serving as a voltage supply unit for the developing roller 4, respectively. The surface of the photosensitive drum 1 is uniformly charged by bringing the charge roller 2 into abutment against the surface of the photosensitive drum 1 and applying a charging voltage from the charging voltage source 20 to the charge roller 2.

The intermediate transfer belt 80 is supported by three rollers of a secondary transfer opposing roller 86, a drive roller 14, and a tension roller 15 each serving as a tension member, and is configured to maintain appropriate tension. The intermediate transfer belt 80 moves in the arrow direction in FIG. 1A substantially at the same speed by being driven by the drive roller 14. Further, a primary transfer roller 81 is arranged on the opposite side to the photosensitive drum 1 across the intermediate transfer belt 80, and is connected to a primary transfer voltage source serving as a voltage supply unit for the primary transfer roller 81. When a primary transfer voltage is applied to the primary transfer roller 81, the toner images formed on the photosensitive drums 1 (on the image bearing members) are sequentially transferred onto the intermediate transfer belt 80 held in contact with the photosensitive drums 1, to form a multicolor image on the intermediate transfer belt 80. In addition, a static eliminating member is arranged on the downstream side of each primary transfer roller 81 in a direction in which the intermediate transfer belt 80 moves. The drive roller 14, the tension roller 15, the static eliminating member 23, and the secondary transfer opposing roller 86 to be described later are electrically grounded.

(Sheet Feeding Section)

A sheet P serving as a recording material is placed in a sheet feeding cassette 16. When the sheet P is fed, a cassette pick-up roller 17 is driven by a stepping motor (not shown) (hereinafter referred to as "sheet feeding motor"), to lift a sheet feeding cassette base plate 29 and push up the sheet P placed in the sheet feeding cassette 16. The top one of the sheets P that have been pushed up is brought into abutment against the cassette pick-up roller 17, and the sheets P are fed while being separated one by one due to rotation of the cassette pick-up roller 17. When the fed sheet P is conveyed to a registration roller 18, and when a registration sensor 35 serving as a detection unit configured to detect the recording material detects a leading edge (edge part on the downstream side in the conveyance direction) of the sheet P, the sheet feeding motor (not shown) stops the driving, to temporarily stop conveying the sheet P. The sheet P that has been temporarily stopped at the registration roller 18 restarts being conveyed (or is re-conveyed) at a predetermined timing in accordance with the toner image formed on the intermediate transfer belt 80, to be conveyed to a secondary transfer portion. Further, the size of the sheet P (length in the conveyance direction; hereinafter referred to as "sheet size") is determined based on an elapsed time since a timing (time point) at which the sheet P is re-conveyed until a timing (time point) at which a trailing edge (edge part on the upstream side in the conveyance direction) of the sheet P is detected by the registration sensor 35.

(Secondary Transfer Portion)

The intermediate transfer belt 80 onto which the toner image formed on the photosensitive drum 1 in each image station has been transferred is caused to move by the drive roller 14, and the toner image that has been transferred onto the intermediate transfer belt 80 is conveyed to an abutting portion between a secondary transfer roller 82 and the intermediate transfer belt 80. Then, the sheet P and the intermediate transfer belt 80 are nipped and conveyed by the secondary transfer roller 82 and the secondary transfer opposing roller 86 arranged so as to be opposed to the secondary transfer roller 82, and applies a voltage to the secondary transfer roller 82 from a secondary transfer voltage source 85. With this configuration, the toner image formed on the intermediate transfer belt 80 is transferred onto the sheet P.

(Fixing Section)

A fixing section 19 serving as a fixing unit applies heat and pressure to the toner image formed on the sheet P, to thereby fix the toner image onto the sheet P. The fixing section 19 includes a fixing belt 19*a* and a pressure roller 19*b*, and the pressure roller 19*b* sandwiches the fixing belt 19*a*, and forms a fixing nip portion together with a belt guide member (not shown) by a predetermined press-contact force. In a state in which a temperature of the fixing nip portion is adjusted to a predetermined temperature, the sheet P on which an unfixed toner image has been formed is introduced between the fixing belt 19*a* and the pressure roller 19*b* at the fixing nip portion with an image surface facing upward, in other words, so as to be opposed to a surface of the fixing belt 19*a*. Then, at the fixing nip portion, the image surface of the sheet P is brought into close contact with an outer surface of the fixing belt 19*a*, and the sheet P is nipped and conveyed through the fixing nip portion. In a process in which the sheet P is nipped and conveyed through the fixing nip portion by the fixing belt 19*a*, the toner image formed on the sheet P is heated by the fixing belt 19*a*, and the unfixed toner image is heated and fixed onto the sheet P.

[System Configuration of Image Forming Apparatus]

Figure 1B:
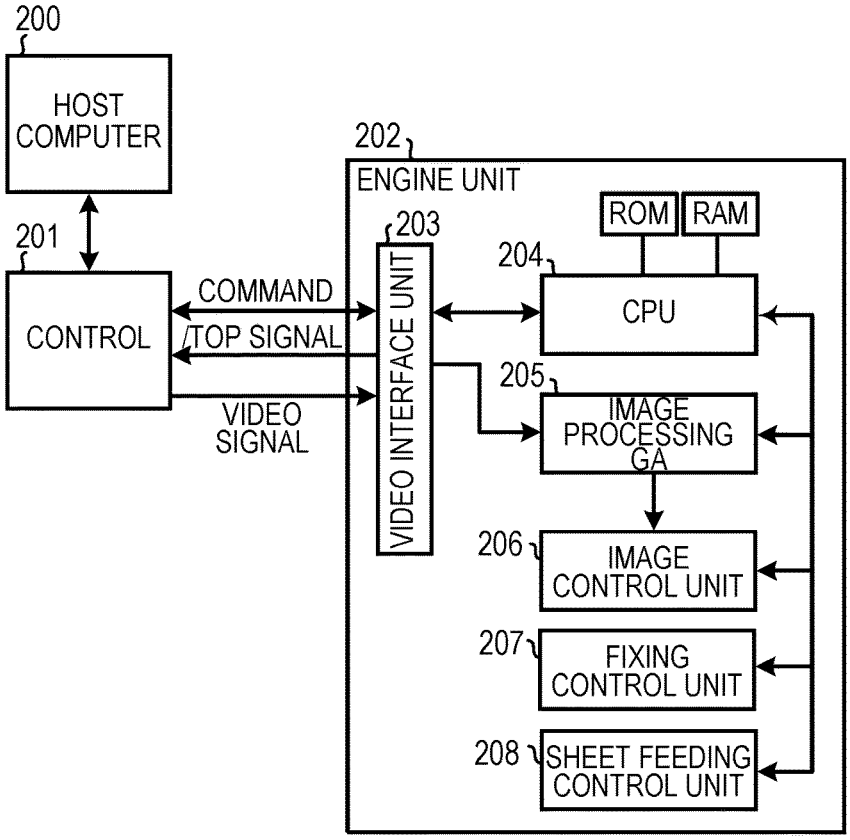
FIG. 1B is a block diagram for illustrating an overall system configuration of the image forming apparatus.

FIG. 1B is a block diagram for illustrating an overall system configuration of the image forming apparatus. In FIG. 1B, the image forming apparatus includes a control unit 201 and an engine unit 202. The control unit 201 is allowed to mutually communicate to/from a host computer 200 serving as an external apparatus and the engine unit 202. The control unit 201 serving as an output unit for an image signal receives a printing instruction including print data (image information) and printing conditions from the host computer 200, and expands bitmap data (image data) based on the received print data. After finishing expanding the bitmap data, the control unit 201 transmits image size information and a printing reservation command to a CPU 204 via a video interface unit 203 in accordance with the printing instruction received from the host computer 200. Then, at a timing at which the engine unit 202 enters a printable state (state ready for image formation), the control unit 201 transmits the printing start command to the CPU 204.

The engine unit 202 includes the video interface unit 203, the CPU 204, an image processing gate array (GA) 205, an image control unit 206, a fixing control unit 207, and a sheet feeding control unit 208. The CPU 204, the image processing GA 205, the image control unit 206, the fixing control unit 207, and the sheet feeding control unit 208 are connected to one another via a two-way bus, and transmits/receives data to/from one another via the two-way bus. The video interface unit 203 relays a signal between the engine unit 202 and the control unit 201. The image control unit 206 controls the above-mentioned image forming unit, the fixing control unit 207 controls the above-mentioned fixing section 19, and the sheet feeding control unit 208 controls the above-mentioned sheet feeding section. The CPU 204, which is configured to transmit/receive data such as a command to/from the control unit 201, prepares for executing a print job when receiving the printing reservation command from the control unit 201, and waits for the printing start command to be transmitted from the control unit 201. When receiving the printing start command, the CPU 204 instructs the respective control units (image control unit 206, fixing control unit 207, and sheet feeding control unit 208) to start a printing operation in accordance with information on the printing reservation command. Note that, the CPU 204 includes a ROM and a RAM. The ROM stores a control program executed by the CPU 204 and data therefor, and the RAM is a memory used by the control program executed by the CPU 204 for temporarily saving information. Further, the image control unit 206, the sheet feeding control unit 208, and the like also include a CPU, a ROM, and a RAM (not shown), and in the same manner as the CPU 204, the ROM stores a control program and data, and the RAM is used by the control program for temporarily saving information.

The image control unit 206 serving as a control unit starts preparing for the image formation when receiving the instruction for the printing operation start. When receiving the notification that the image formation has been prepared from the image control unit 206, the CPU 204 outputs a /TOP signal, which serves as a timing signal to be a reference timing at which the video signal is output, to the control unit 201 via the video interface unit 203. When receiving the /TOP signal from the CPU 204, the control unit 201 outputs the video signal, which is generated from the bitmap data with reference to the timing at which the /TOP signal was received, to the image processing GA 205 via the video interface unit 203. When receiving the video signal from the control unit 201, the image processing GA 205 converts the received video signal into the data for the image formation, and transmits the data to the image control unit 206. The image control unit 206 performs the image formation based on the data for the image formation received from the image processing GA 205. Note that, when continuous printing is performed, as described later, the image control unit 206 determines an image formation interval serving as a time interval at which the /TOP signal is output based on a sheet size or an image size to be described later that has been received from the control unit 201. Then, the image control unit 206 instructs the CPU 204 to transmit the /TOP signal in accordance with the image formation interval.

When receiving the instruction to start the printing operation from the CPU 204, the sheet feeding control unit 208 starts a sheet feeding operation. The sheet feeding control unit 208 drives a sheet feeding motor (not shown) to convey a sheet placed in the sheet feeding cassette 16 (hereinafter referred to as "sheet feeding unit") to the secondary transfer position, and detects the sheet size by using the registration sensor 35 illustrated in FIG. 1A. Note that, the sheet size of the sheet placed in the sheet feeding unit is assumed to be indefinite during a period after the printing operation is started until the registration sensor 35 detects the sheet size.

When receiving the instruction to start the printing operation, the fixing control unit 207 starts preparing for fixing processing, and starts temperature adjustment based on paper type information (for example, thickness of the sheet) set in the printing reservation command in accordance with a timing at which the sheet subjected to the secondary transfer is conveyed to the fixing section 19. The fixing control unit 207 fixes the image (toner image) onto the sheet, and then conveys (delivers) the sheet to an outside thereof.

[Outline of Printing Operation]

Next, the printing operation performed by the image forming apparatus for the sheet whose sheet size is unknown (referred to also as "indefinite size") at a time point at which the printing operation is instructed by the host computer 200 (start time point of the print job) is described. Note that, the maximum size of the sheet (hereinafter referred to also as "maximum support size"), on which the image forming apparatus according to this embodiment can form an image and which can be conveyed along a conveying path, is set to a legal size (sheet size: 355.6 mm), and is hereinafter referred to as "LGL size". Further, the size of the sheet placed in the sheet feeding cassette 16 in actuality in this embodiment is set to a letter size (sheet size: 279.4 mm), and is hereinafter referred to as "LTR size". In addition, an interval between a sheet and a sheet (hereinafter referred to as "sheet interval") that is at least necessary in performing the printing operation is set to 40 mm.

[Outline of Related-Art Printing Operation]

Figure 2A:
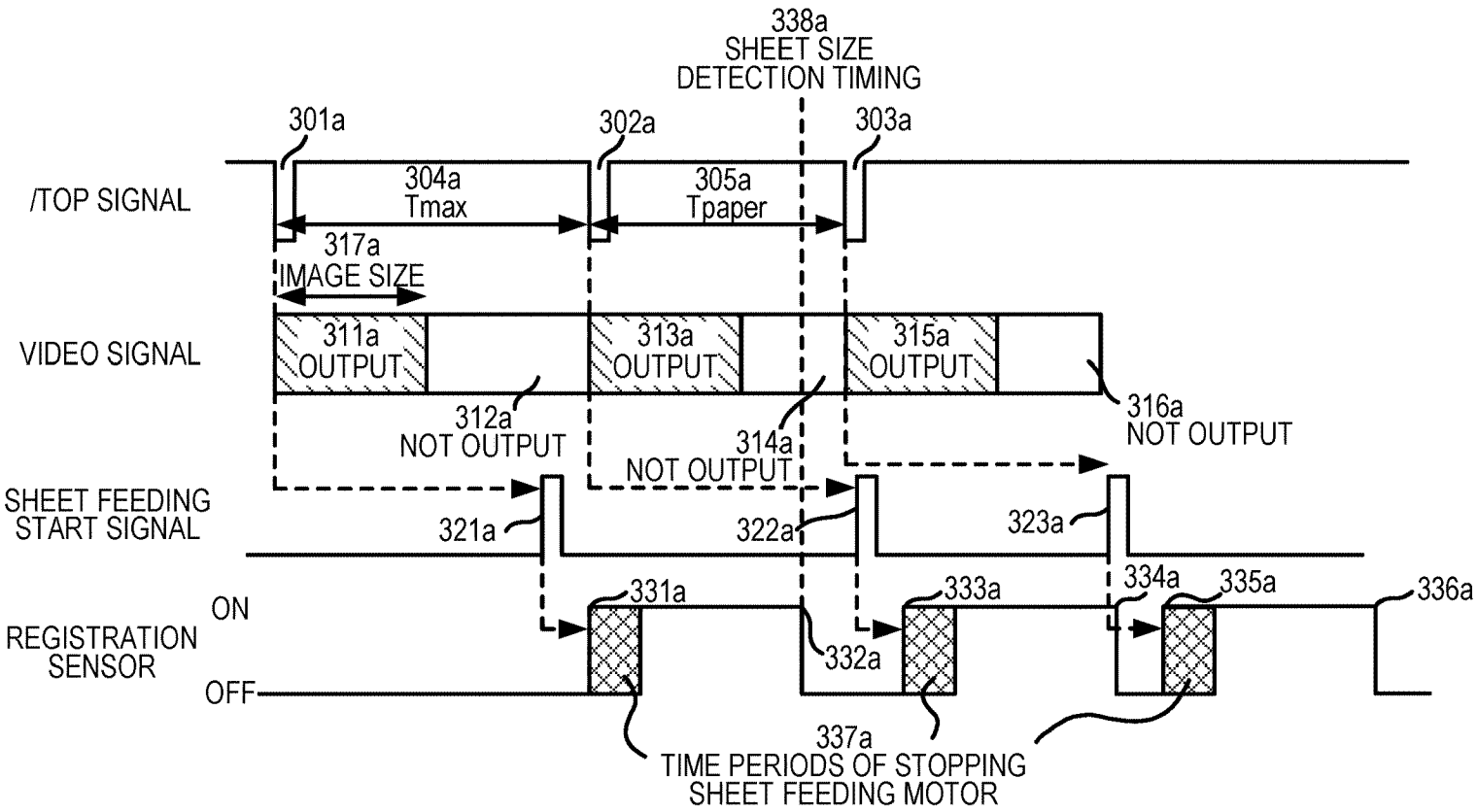
FIG. 2A and FIG. 2B illustrate timing charts of related-art image formation for comparison with the embodiments.
Figure 2B:
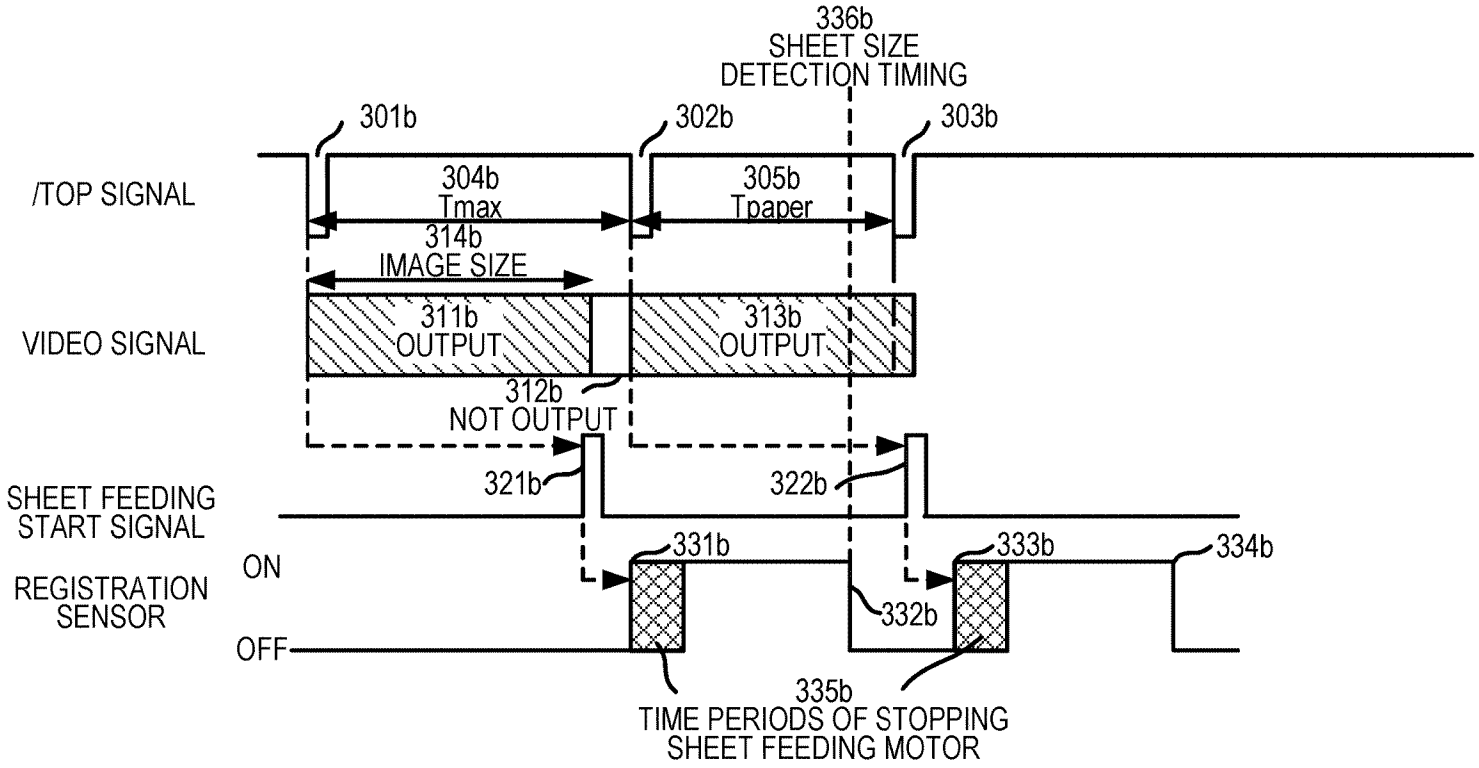

First, related art of an image forming apparatus configured to perform a printing operation in accordance with the sheet size detected by the registration sensor 35 is described with reference to FIG. 2A and FIG. 2B. FIG. 2A and FIG. 2B are timing charts each illustrating a signal state relating to the printing operation performed for continuous printing when the sheet size of the sheet placed in the sheet feeding unit is unknown at the time point at which the printing operation is instructed. FIG. 2A also illustrates the output period of the video signal output from the control unit 201. The output period in FIG. 2A means a relative time interval. FIG. 2A illustrates a timing of the printing operation performed when the image size corresponds to 200 mm that is the length of the sheet in the conveyance direction. On the other hand, FIG. 2B illustrates a timing of the printing operation performed when the output period of the video signal output from the control unit 201 corresponds to 350 mm that is the length of the sheet in the conveyance direction. Here, the output period of the video signal represents a period during which the video signal corresponding to an image of one page including a margin part is output.

(Case of (Image Size)<(Sheet Size))

FIG. 2A is a timing chart of the printing operation performed when the image size of the video signal output from the control unit 201 is smaller than the sheet size of the sheet to be subjected to the image formation. In FIG. 2A, the vertical axial direction indicates the /TOP signal, the video signal, a sheet feeding start signal, and states of the registration sensor 35 in order from the top, and the horizontal axial direction indicates time. In FIG. 2A, /TOP signals 301*a*, 302*a*, and 303*a* are signals transmitted from the engine unit 202 to the control unit 201, and $T_{max}$ 304*a* and $T_{paper}$ 305*a* each indicate an image formation interval serving as an interval at which the /TOP signal is output. Further, hatched outputs 311*a*, 313*a*, and 315*a* each indicate a period during which the video signal is output (image size), and not-outputs 312*a*, 314*a*, and 316*a* each indicate a period during which the video signal is not output from the control unit 201. Sheet feeding start signals 321*a*, 322*a*, and 323*a* are each a signal indicating a start timing to feed the sheet from the sheet feeding cassette 16. Further, in the field indicating the registration sensor, ON indicates a state in which the registration sensor 35 detects the sheet, and OFF indicates a state in which the sheet is not detected. Timings 331*a*, 333*a*, and 335*a* at which the state of the registration sensor 35 changes from OFF to ON each indicate a timing at which the registration sensor 35 detects the leading edge of the sheet. On the other hand, timings 332*a*, 334*a*, and 336*a* at which the state of the registration sensor 35 changes from ON to OFF each indicate a timing at which the registration sensor 35 detects the trailing edge of the sheet. Further, a hatched sheet feeding motor stop period 337*a* indicates a period during which the sheet feeding motor is stopped until the conveyance of the sheet is restarted at a predetermined timing in accordance with the toner image formed on the intermediate transfer belt 80. Note that, in the following description, the parenthesized reference symbols indicate the reference symbols of the signals illustrated in FIG. 2A.

As the printing operation illustrated in FIG. 2A, the engine unit 202 performs a preparation operation for the printing operation when receiving the printing start command from the control unit 201. When completing the preparation operation, the /TOP signal (301*a*) for the first sheet is output, and the /TOP signal for the following sheet is output so that a distance between the sheets becomes a desired interval (302*a* and 303*a*). The engine unit 202 outputs the /TOP signal for each sheet, and then starts the sheet feeding operation at a predetermined timing (321*a*, 322*a*, and 323*a*). The engine unit 202 temporarily stops the conveyance of the sheet at the time point (331*a*, 333*a*, and 335*a*) at which the sheet reaches the registration sensor 35 (337*a*), and restarts the conveyance of the sheet in accordance with the conveyance of the intermediate transfer belt 80 on which the toner image has been formed, to thereby transfer the toner image onto the sheet.

In FIG. 2A, when receiving the notification that the image formation has been prepared from the image control unit 206, the CPU 204 of the engine unit 202 outputs the /TOP signal (301*a*) for the first sheet. At this time point, the sheet size of the sheet placed in the sheet feeding unit is indefinite, and hence the image control unit 206 sets a $T_{max}$ (304*a*) for an output interval T serving as a time interval at which the /TOP signal for the following sheet is output by assuming that the sheet size is the LGL size that is the maximum support size. The output interval $T_{max}$ (304*a*) is specifically a time period required for the sheet of LGL size (355.6 mm) to be conveyed on the conveying path at a predetermined conveyance speed while maintaining the sheet interval (40 mm) with respect to the following sheet. Note that, in the following description, for the sake of description, the output interval T is expressed by the length instead of the time. For example, the output interval $T_{max}$ is (LGL size (355.6 mm))+(sheet interval (40 mm)) when expressed by the length. Further, the image control unit 206 determines the output interval T of the /TOP signal, and instructs the CPU 204 to transmit the /TOP signal at every output interval T, and the /TOP signal is output from the CPU 204 to the control unit 201.

The sheet feeding control unit 208 starts the sheet feeding operation at a predetermined timing after the CPU 204 outputs the /TOP signal (301*a*) for the first sheet (321*a*). Then, at the time point (331*a*) at which the fed sheet reaches the registration sensor 35, the sheet feeding control unit 208 stops the sheet feeding motor (337*a*), and temporarily stops the conveyance of the sheet. After that, in accordance with a timing at which the toner image formed on the intermediate transfer belt 80 is transferred onto the sheet, the sheet feeding control unit 208 restarts the sheet conveyance, and the toner image on the intermediate transfer belt 80 is transferred onto the sheet at the secondary transfer portion. Then, at a timing (332*a*) at which the trailing edge of the sheet is detected by the registration sensor 35, the sheet feeding control unit 208 determines the sheet size of the first sheet (338*a*), and notifies the image control unit 206 of the sheet size. Note that, the sheet feeding control unit 208 can determine the sheet size that is the length of the sheet in the conveyance direction by multiplying the conveyance speed of the sheet by a time period after the conveyance of the sheet is restarted until the registration sensor 35 detects the trailing edge of the sheet. The time period after the conveyance of the sheet is restarted until the registration sensor 35 detects the trailing edge of the sheet also represents a time period obtained by subtracting the sheet feeding motor stop period 337*a* from a time period between the timing 331*a* and the timing 332*a*. Based on the sheet size notified of by the sheet feeding control unit 208, the image control unit 206 sets $T_{paper}$ (305*a*) for the output interval T of the /TOP signal for the following sheet. In the continuous printing operation, in order to increase throughput that is the number of sheets subjected to the image formation per unit time, the output interval T of the /TOP signal is set as follows. That is, the output interval $T_{paper}$ (305*a*) specifically represents a time period required for the sheet whose sheet size is the LTR size (279.4 mm) to be conveyed on the conveying path at a predetermined conveyance speed while maintaining the sheet interval (40 mm) with respect to the following sheet. Note that, in the following description, the output interval $T_{paper}$ is expressed by the length of (LTR size (279.4 mm))+(sheet interval (40 mm)) instead of the time.

When the output interval $T_{paper}$ (305*a*) has already elapsed since the previous /TOP signal (302*a*) was output, the image control unit 206 instructs the CPU 204 at that time point to output the /TOP signal (303*a*) for the subsequent sheet. On the other hand, when the output interval $T_{paper}$ (305*a*) has not elapsed since the previous /TOP signal (302*a*) was output, the image control unit 206 instructs the CPU 204 to output the /TOP signal at the subsequent timing. That is, the image control unit 206 instructs the CPU 204 to output the /TOP signal (303*a*) after the output interval $T_{paper}$ (305*a*) has elapsed since the previous /TOP signal (302*a*) was output. After that, when performing the continuous printing, the image control unit 206 performs the printing operation with the output interval $T_{paper}$ (305*a*) being set for the output interval T of the /TOP signal.

In FIG. 2A, the output interval $T_{paper}$ (305*a*) represents a time period required for the sheet whose sheet size is the LTR size (279.4 mm) to be conveyed on the conveying path at a predetermined conveyance speed while maintaining the sheet interval (40 mm) with respect to the following sheet. On the other hand, an image size 317*a* serving as the output period of the video signal to be used to form the image on the sheet corresponds to 200 mm that is the length of the sheet in the conveyance direction, and is equal to the time period required for the sheet having a length of 200 mm in the conveyance direction to be conveyed at a predetermined conveyance speed. Accordingly, the /TOP signal for the subsequent sheet is not output from the engine unit 202 while the control unit 201 is outputting the video signal for the leading sheet.

(Case of (Image Size)>(Sheet Size))

FIG. 2B is a timing chart of the printing operation performed when the image size of the video signal output from the control unit 201 is larger than the sheet size of the sheet to be subjected to the image formation. In FIG. 2B, in the same manner as in FIG. 2A, the vertical axial direction indicates the /TOP signal, the video signal, the sheet feeding start signal, and the states of the registration sensor 35 in order from the top, and the horizontal axial direction indicates time. Further, FIG. 2B is different from FIG. 2A in that the suffix "b" is added to the reference symbols in FIG. 2B while the suffix "a" is added in FIG. 2A, but is the same as FIG. 2A in terms of the meaning of each signal and the way of understanding the drawing, and hence a description thereof is omitted. Note that, in the following description, the parenthesized reference symbols indicate the reference symbols of the signals illustrated in FIG. 2B.

In FIG. 2B, in the same manner as in FIG. 2A, when receiving the notification that the image formation has been prepared from the image control unit 206, the CPU 204 outputs a /TOP signal (301*b*) for the first sheet. At this time point, the sheet size of the sheet placed in the sheet feeding unit is indefinite, and hence the image control unit 206 sets $T_{max}$ (304*b*) for the output interval T of the /TOP signal for the following sheet by assuming that the sheet size is the LGL size that is the maximum support size. In the same manner as in FIG. 2A, the output interval $T_{max}$ (304*b*) is expressed by (LGL size (355.6 mm))+(sheet interval (40 mm)).

The sheet feeding control unit 208 and the image control unit 206 each perform the same control as in FIG. 2A also in regard to the sheet feeding and conveyance control. That is, at a time point (336*b*) at which the detection of the first sheet size is finished, the sheet feeding control unit 208 determines the first sheet size, and notifies the image control unit 206 of the sheet size. Based on the notified sheet size, the image control unit 206 sets $T_{paper}$ (305*b*) for the output interval T of the /TOP signal for a /TOP signal (303*b*) for the following sheet. In the same manner as in FIG. 2A, the output interval $T_{paper}$ (305*b*) is expressed by (LTR size (279.4 mm))+(sheet interval (40 mm)).

However, unlike in FIG. 2A, in FIG. 2B, outputs 311*b* (image size 314*b*) and 313*b* serving as the output period of the video signal output by the control unit 201 correspond to 350 mm that is the length of the sheet in the conveyance direction. Further, the length of the time period of the outputs 311*b* (image size 314*b*) and 313*b* serving as the output period of the video signal output by the control unit 201 are the same as the time period required for the sheet having a length of 350 mm in the conveyance direction to be conveyed at a predetermined conveyance speed. Therefore, in the first printing operation in which the image is formed at the output interval $T_{max}$ of the /TOP signal set to the LGL size that is the maximum support size, there is no problem because the image size 317*a* (350 mm)<$T_{max}$(=(355.6 mm)+(40 mm)). However, when the /TOP signal is output (303*b*) with $T_{paper}$ (305*b*) being set for the output interval T of the /TOP signal, the following situation occurs. That is, the image size 314*b* (350 mm)>$T_{paper}$(=(279.4 mm)+(40 mm)), and hence the video signal for the third sheet is output while the video signal for the second sheet is being output. As a result, there occurs an overlap between the output period of the video signal for the second sheet and the output period of the video signal for the third sheet, which inhibits the image formation from being performed normally.

[Outline of Printing Operation According to this Embodiment]

In this embodiment, in such a case as described above with reference to FIG. 2B, the control unit 201 determines the output interval T of the /TOP signal in consideration of not only the sheet size but also the image size serving as a period during which the video signal is output. With this configuration, deterioration in productivity is suppressed, and the image formation is performed normally without an overlap between the output periods of the video signals.

Figure 3:
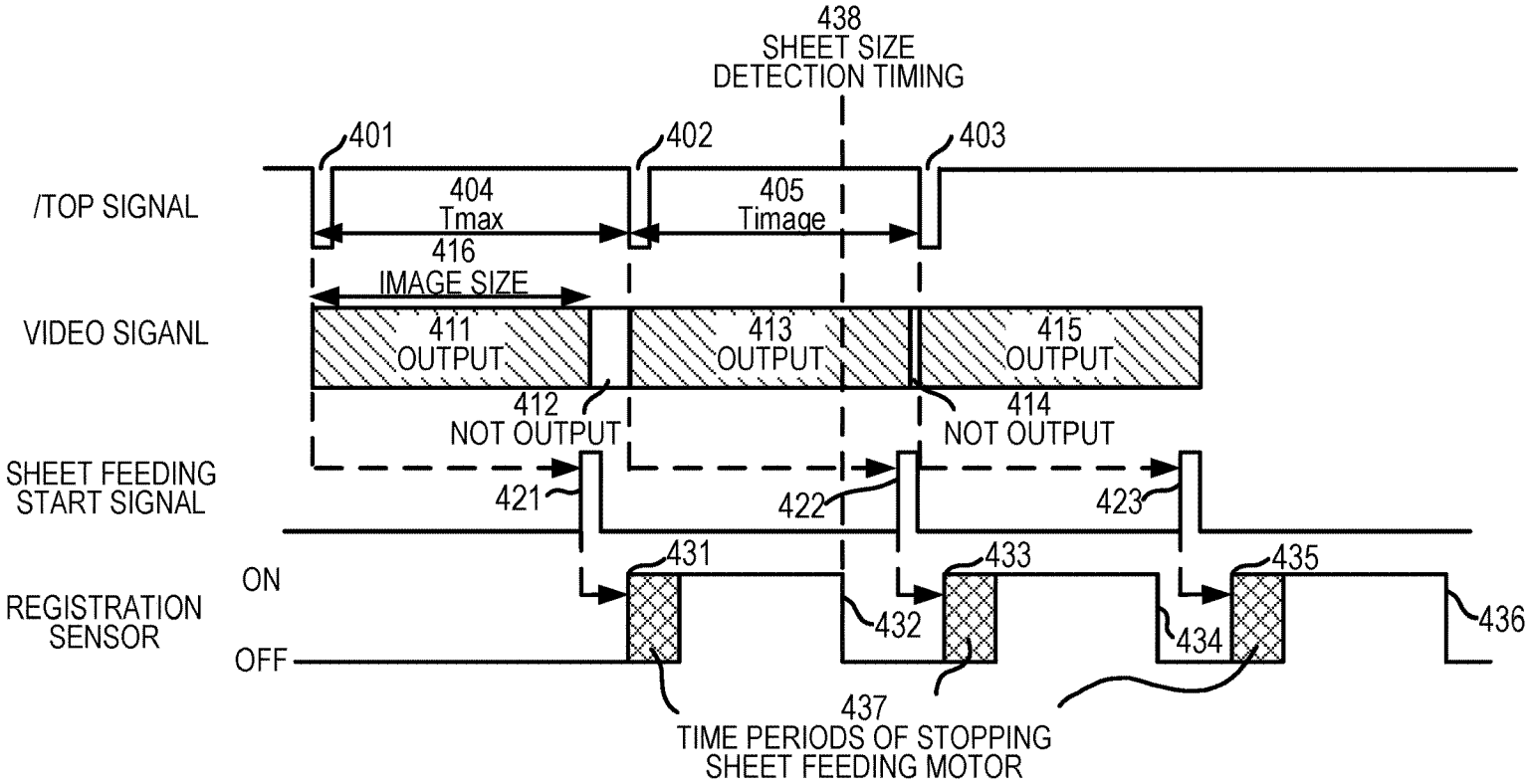
FIG. 3 illustrates a timing chart of image formation according to the first embodiment.

FIG. 3 is a timing chart illustrating the printing operation for performing the continuous printing in this embodiment when the same video signal as in FIG. 2B is being output from the control unit 201. In FIG. 3, in the same manner as in FIGS. 2A and 2B, the vertical axial direction indicates the /TOP signal, the video signal, the sheet feeding start signal, and the states of the registration sensor 35 in order from the top, and the horizontal axial direction indicates time. FIG. 3 is the same as FIGS. 2A and 2B in terms of the meaning of each signal and the way of understanding the drawing, and hence a description thereof is omitted. Note that, in the following description, the parenthesized reference symbols indicate the reference symbols of the signals illustrated in FIG. 3. This embodiment is described below in the same manner as in FIG. 2B on the assumption that an image size 416 (outputs 411, 413, and 415) output from the control unit 201 to the engine unit 202 corresponds to 350 mm that is the length of the sheet in the conveyance direction. Note that, in this embodiment, before transmitting the printing start command to the CPU 204 of the engine unit 202, the control unit 201 notifies the CPU 204 of the engine unit 202 of the image size 416 of the image output to the engine unit 202 by the control unit 201. The CPU 204 notifies the image control unit 206 of the notified image size. After that, the control unit 201 transmits the printing start command to the CPU 204 of the engine unit 202.

In FIG. 3, when receiving the notification that the image formation has been prepared from the image control unit 206, the CPU 204 of the engine unit 202 outputs a /TOP signal (401) for the first sheet. At this time point, the sheet size of the sheet placed in the sheet feeding unit is indefinite, and hence the image control unit 206 sets $T_{max}$ (404) for an output interval T of the /TOP signal for the following sheet by assuming that the sheet size is the LGL size that is the maximum support size. The output interval $T_{max}$ (404) serving as a first time interval is (LGL size (355.6 mm))+(sheet interval (40 mm)) when expressed by the length. Note that, the image control unit 206 determines the output interval T of the /TOP signal, and instructs the CPU 204 to transmit the /TOP signal at every output interval T, and the /TOP signal is output from the CPU 204 to the control unit 201.

The sheet feeding control unit 208 starts the sheet feeding operation at a predetermined timing after the CPU 204 outputs the /TOP signal (401) for the first sheet (421). Then, at a time point (431) at which the fed sheet reaches the registration sensor 35, the sheet feeding control unit 208 stops the sheet feeding motor (437), and temporarily stops the conveyance of the sheet. After that, in accordance with a timing at which the toner image formed on the intermediate transfer belt 80 is transferred onto the sheet, the sheet feeding control unit 208 restarts the sheet conveyance, and the toner image on the intermediate transfer belt 80 is transferred onto the sheet at the secondary transfer portion. Then, at a timing (432) at which the trailing edge of the sheet is detected by the registration sensor 35, the sheet feeding control unit 208 determines the sheet size of the first sheet (438), and notifies the image control unit 206 of the sheet size. Note that, the sheet feeding control unit 208 can determine the sheet size that is the length of the sheet in the conveyance direction by multiplying the conveyance speed of the sheet by a time period after the conveyance of the sheet is restarted until the registration sensor 35 detects the trailing edge of the sheet. Then, the image control unit 206 determines the output interval T of the /TOP signal (403) for the following sheet serving as a second time interval based on the output interval $T_{paper}$ and an output interval $T_{image}$ The output interval $T_{paper}$ is the output interval calculated based on the sheet size notified of by the sheet feeding control unit 208, and the output interval $T_{image}$ is the output interval calculated based on the image size notified of by the control unit 201 via the CPU 204 in advance before the printing is started. The image control unit 206 determines the output interval T of the /TOP signal so that the /TOP signal (403) for the following sheet is not output while the control unit 201 is outputting the video signal. Note that, in FIG. 3, it is assumed that an output interval $T_{image}$ (405) based on the image size serving as the output period of the video signal is set as the output interval T. Further, a method of calculating the output interval $T_{image}$ (405) of the /TOP signal is described later with reference to FIG. 4.

When the output interval $T_{image}$ (405) has already elapsed since the previous /TOP signal (402) was output, the image control unit 206 instructs the CPU 204 at that time point to output the /TOP signal (403) for the subsequent sheet. On the other hand, when the output interval $T_{image}$ (405) has not elapsed since a previous /TOP signal (402) was output, the image control unit 206 instructs the CPU 204 to output the /TOP signal at the subsequent timing. That is, the image control unit 206 instructs the CPU 204 to output the /TOP signal (403) after the output interval $T_{image}$ (405) has elapsed since the previous /TOP signal (402) was output. After that, when performing the continuous printing, the image control unit 206 performs the printing operation with the output interval $T_{image}$ (405) being set for the output interval T serving as the time interval at which the /TOP signal is output. Note that, not-outputs 412 and 414 each indicate a period during which the video signal is not being output from the control unit 201. Further, the sheet feeding start signals 422 and 423 each indicate a timing at which the sheet feeding of the sheet is started from the sheet feeding cassette 16. Timings 431, 433, and 435 at which the state of the registration sensor 35 changes from OFF to ON each indicate a timing at which the registration sensor 35 detects the leading edge of the sheet. On the other hand, timings 432, 434, and 436*a* at which the state of the registration sensor 35 changes from ON to OFF each indicate a timing at which the registration sensor 35 detects the trailing edge of the sheet.

Further, in this embodiment, when the image size is larger than the sheet size, a part of an image existing beyond the sheet is not formed on the photosensitive drum 1. For example, a mask is applied to the scanning unit 11, to thereby prevent the photosensitive drum 1 from being irradiated with the scanning beam 12 corresponding to the part of the image existing beyond the sheet. With this configuration, it is possible to suppress unnecessary toner consumption, and prevent a transfer roller from being stained.

[Control Sequence of Image Formation]

Figure 4:
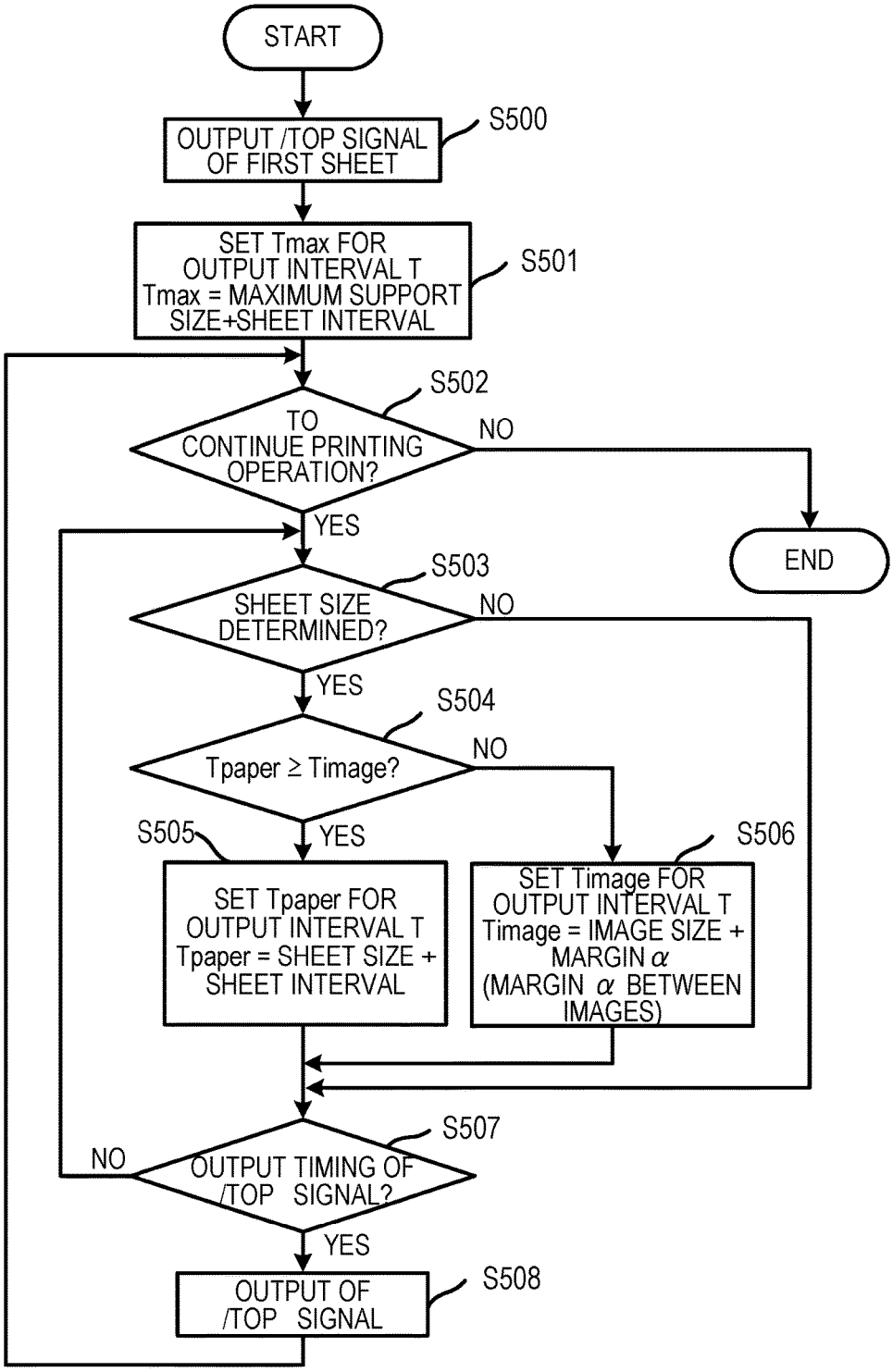
FIG. 4 illustrates a flowchart of a control sequence of the image formation according to the first embodiment.

FIG. 4 is a flowchart illustrating a control sequence for determining the output interval T of the /TOP signal and outputting the /TOP signal to the control. The processing illustrated in FIG. 4 is activated when the control unit 201 that has received the printing instruction from the host computer 200 transmits the image size information and the printing reservation command to the CPU 204 of the engine unit 202 in accordance with the printing instruction received from the host computer 200. Note that, it is assumed that the image control unit 206 has been notified of the image size information via the CPU 204 at a time point when the processing illustrated in FIG. 4 is activated.

In FIG. 4, in Step 500 (hereinafter referred to as "S500"; the same applies to the other step numbers), when receiving the printing reservation command from the control unit 201, the CPU 204 prepares for executing the printing operation (printing), and waits for the transmission of the printing start command from the control unit 201. When receiving the printing start command, the CPU 204 instructs the image control unit 206, the fixing control unit 207, and the sheet feeding control unit 208 to start the printing operation in accordance with information on the printing reservation command.

When receiving the instruction to start the printing operation, the image control unit 206 starts preparing for the image formation, and when completing the preparation, transmits a completion notification to the CPU 204, and resets and starts a timer configured to measure the time interval at which the /TOP signal is output. When receiving the preparation completion notification from the image control unit 206, the CPU 204 outputs the /TOP signal for the first sheet to the control unit 201 as illustrated in FIG. 3 (401).

In S501, because the sheet size is indefinite, the image control unit 206 sets the output interval $T_{max}$, which is required for the sheet of the maximum support size to be conveyed while maintaining a predetermined sheet interval ((maximum support size)+(sheet interval)), for the output interval T of the /TOP signal as illustrated in FIG. 3 (404). In this embodiment, as described above, the maximum support size of the sheet is the LGL size (sheet length: 355.6 mm), and the output interval $T_{max}$ is expressed by the length of (maximum support size (355.6 mm))+(sheet interval (40 mm)). The time period of the output interval $T_{max}$ can be calculated by adding the sheet interval (40 mm) to the maximum support size (355.6 mm) and dividing the sum by a predetermined sheet conveyance speed.

In S502, in order to determine whether or not to continue the printing operation, the image control unit 206 determines whether or not the printing start command serving as a printing instruction for the subsequent sheet has been received from the control unit 201 via the CPU 204. When determining that the printing start command has been received, the image control unit 206 advances to S503 in order to continue the printing operation, and when determining that the printing start command has not been received, determines that the printing operation is not to be continued, to bring the processing to an end.

In S503, the image control unit 206 determines whether or not the sheet size has been determined based on presence/absence of the notification of the sheet size of the sheet conveyed along the conveying path from the sheet feeding control unit 208. The sheet feeding control unit 208 determines the sheet size based on the conveyance speed of the sheet and a time period after the registration sensor 35 detects the leading edge of the sheet conveyed along the conveying path until the trailing edge of the sheet is detected (excluding a sheet feeding motor stop period 437), and notifies the image control unit 206 of the determined sheet size. When receiving the notification of the sheet size from the sheet feeding control unit 208, the image control unit 206 determines that the sheet size has been determined, and advances to S504. When the notification of the sheet size has not been received, the image control unit 206 determines that the sheet size has not been determined, and advances to S507.

In S504, the image control unit 206 calculates the output interval $T_{paper}$ of the /TOP signal based on the sheet size and the output interval $T_{image}$ of the /TOP signal based on the image size notified of by the control unit 201 via the CPU 204 illustrated in FIG. 3 (416). The method of calculating the output interval $T_{paper}$ has been described above with reference to FIG. 2, and hence a description thereof is omitted. Before the printing is started, the output interval $T_{image}$ is calculated based on the total sum of the image size that is the length (time period) of the output period of the video signal notified of by the control unit 201 and a margin α (time period) between images (video signals). The margin α indicates the length (time period) of the period during which the video signal is not output and which is necessary after the control unit 201 finishes outputting the video signal before the output of the subsequent video signal is started, and is a value that differs depending on a constraint of the control unit 201. Then, the output interval $T_{image}$ is calculated by summing up the image size received from the control unit 201 and the margin α between the images (video signals). In the following description, it is assumed that the output interval $T_{image}$ is also expressed by the length in the same manner as the output interval $T_{paper}$ and the output interval $T_{image}$ is expressed by (image size)+(inter-image margin α).

The image control unit 206 performs size comparison between the output interval $T_{paper}$ and the output interval $T_{image}$ that have been calculated, and when determining that (output interval $T_{image}$)≤(output interval $T_{paper}$), the image control unit 206 advances to S505. In S505, the image control unit 206 sets the output interval $T_{paper}$ based on (sheet size)+(sheet interval) for the output interval T at which the /TOP signal is output. On the other hand, when determining that (output interval $T_{image}$)>(output interval $T_{paper}$) the image control unit 206 advances to S506. In S506, the image control unit 206 sets the output interval $T_{image}$ based on (image size)+α for the output interval T at which the /TOP signal is output. In this embodiment, the image size output by the control unit 201 is set to 350 mm, the sheet placed in the sheet feeding cassette 16 is set to have the LTR size (sheet length: 279.4 mm), and the inter-image margin α is set to 5 mm. As a result, (output interval $T_{image}$(=(350 mm)+(5 mm)))>(output interval $T_{paper}$(=(279.4 mm)+(40 mm))). Accordingly, in S504, the image control unit 206 determines that (output interval $T_{image}$)>(output interval $T_{paper}$) and advances to S506. Then, in S506, the image control unit 206 sets the output interval $T_{image}$ corresponding to 355 mm (=(350 mm)+(5 mm)) for the output interval T of the /TOP signal as illustrated in FIG. 3 (405).

In S507, the image control unit 206 reads a timer value from the timer started in S500, and determines whether or not the output interval T at which the /TOP signal is output has elapsed. The image control unit 206 advances to S508 when determining that the output interval T has elapsed, and returns to S503 when determining that the output interval T has not elapsed. In S508, the image control unit 206 instructs the CPU 204 to transmit the /TOP signal as illustrated in FIGS. 3 (402 and 403), and resets and restarts the timer, to return to S502.

Note that, in S504, the size comparison between the output interval $T_{paper}$ and the output interval $T_{image}$ that have been calculated is performed by the length, but the output interval may be calculated as a time period to perform the size comparison. Further, in FIG. 4, the image control unit 206 performs the determination of the output interval T of the /TOP signal and the instruction to transmit the /TOP signal. For example, the sheet feeding control unit 208 may notify the CPU 204 of the sheet size, and the CPU 204 may perform not only the transmission of the /TOP signal but also the determination of the output interval T of the /TOP signal.

As described above, according to this embodiment, it is possible to perform the image formation normally without an overlap between the output periods of the video signals, to thereby suppress the deterioration in productivity. In this embodiment, when the output interval T of the /TOP signal is determined, the image control unit 206 determines the output interval T of the /TOP signal in consideration of not only the size of the sheet placed in the sheet feeding unit detected by the sheet feeding control unit 208 but also the image size of the image to be formed by the control unit 201. With this configuration, the engine unit 202 can suppress the deterioration in productivity, and can perform the image formation normally with an overlap between the output periods of the video signals of the same color.

[Second Embodiment]

In the first embodiment, on the assumption that the sheet size of the sheet placed in the sheet feeding unit is indefinite, the output interval T of the /TOP signal is set to the output interval $T_{max}$ obtained when the sheet size is the maximum support size. Then, at the time point when the sheet size is determined, the output interval T is changed to the output interval $T_{image}$ corresponding to the image size or the output interval $T_{paper}$ corresponding to the detected sheet size. On the other hand, a second embodiment of the present invention is different from the first embodiment in that the printing operation is performed by setting the output interval $T_{image}$ or the output interval $T_{paper}$ for the output interval T of the /TOP signal when the sheet size of the sheet placed in the sheet feeding unit has already been determined before the printing operation is started. Note that, the configuration of the image forming apparatus and the system configuration thereof are the same as those described with reference to FIGS. 1A and 1B in the first embodiment, and hence detailed descriptions thereof are omitted.

[Outline of Printing Operation According to this Embodiment]

In the same manner as in the first embodiment, an operation of the image forming apparatus performed when the printing operation for an indefinite sheet size is instructed by the host computer 200 is described below. In this embodiment, in the same manner as in the first embodiment, it is assumed that the maximum support size of the sheet is set to the LGL size (sheet size: 355.6 mm), the sheet placed in the sheet feeding unit in actuality is set to have the LTR size (sheet size: 279.4 mm), and the sheet interval is set to 40 mm. Further, this embodiment is described below in the same manner as in FIG. 3 in the first embodiment on the assumption that the image size output from the control unit 201 to the engine unit 202 corresponds to 350 mm that is the length of the sheet in the conveyance direction. Note that, in the same manner as in the first embodiment, before transmitting the printing start command to the CPU 204, the control unit 201 notifies the CPU 204 of the engine unit 202 of an image size 616 (outputs 611, 613, and 615) of the image output to the engine unit 202 by the control unit 201. Then, the CPU 204 notifies the image control unit 206 of the notified image size, and then the control unit 201 transmits the printing start command to the CPU 204 of the engine unit 202. Further, in the image forming apparatus, the printing operation has already been performed, the size of the sheet placed in the sheet feeding unit has been determined as the LTR size by the registration sensor 35 of the sheet feeding control unit 208, and the sheet size is stored in the RAM (not shown) of the image control unit 206.

Figure 5:
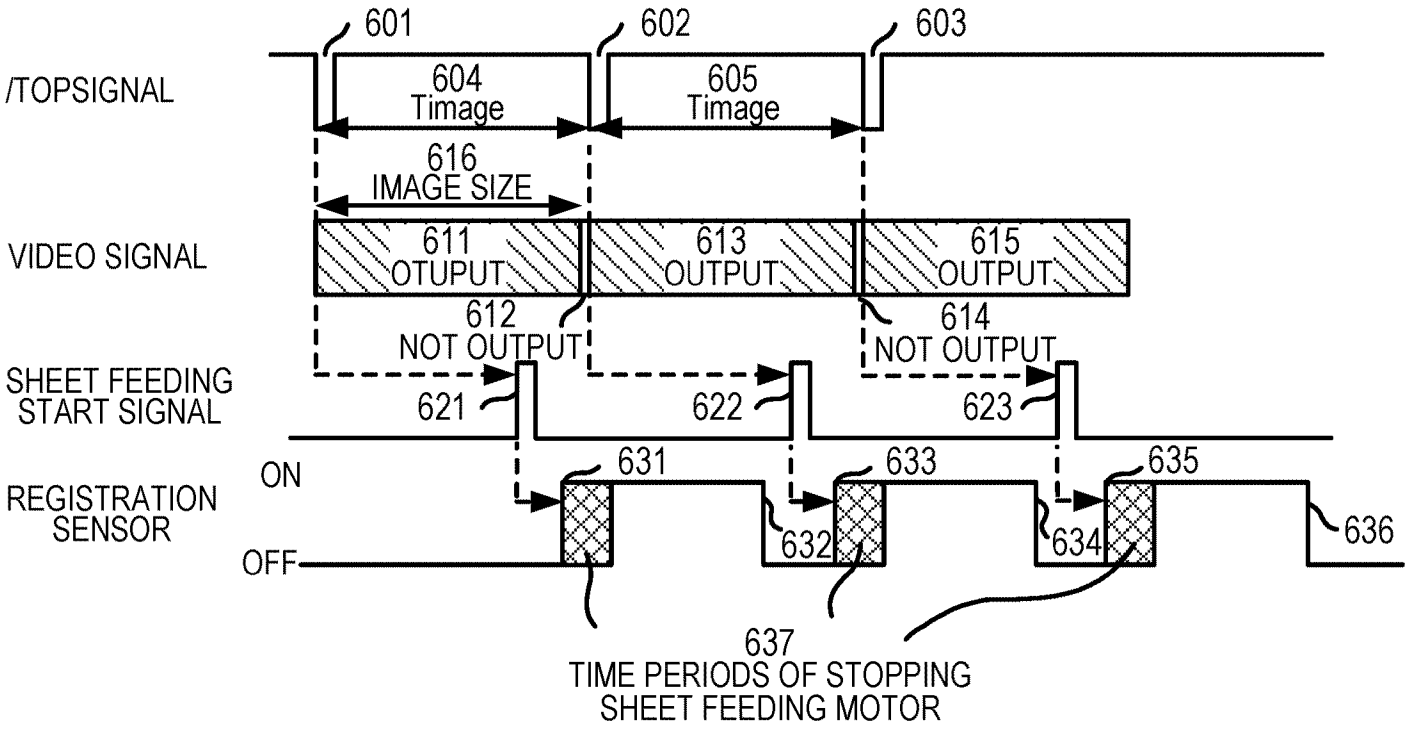
FIG. 5 illustrates a timing chart of image formation according to the second embodiment.

FIG. 5 is a timing chart illustrating the printing operation for performing the continuous printing according to this embodiment. In FIG. 5, in the same manner as in FIG. 3 in the first embodiment, the vertical axial direction indicates the /TOP signal, the video signal, the sheet feeding start signal, and the states of the registration sensor 35 in order from the top, and the horizontal axial direction indicates time. Note that, in FIG. 5, the hundreds digit of the reference symbol is changed from "4" in FIG. 3 to "6", but FIG. 5 is the same as FIG. 3 in terms of the meaning of each signal and the way of understanding the drawing, and hence a description thereof is omitted. Note that, in the following description, the parenthesized reference symbols indicate the reference symbols of the signals illustrated in FIG. 5.

In FIG. 5, when receiving the notification that the image formation has been prepared from the image control unit 206, the CPU 204 of the engine unit 202 outputs a /TOP signal (601) for the first sheet. The sheet size placed in the sheet feeding unit has already been determined, and hence, the output interval T of the /TOP signal for the following sheet serving as a first time interval is set based on the output interval $T_{paper}$ corresponding to the sheet size and the output interval $T_{image}$ corresponding to the image size. The output interval $T_{paper}$ is a time period required for the sheet whose sheet size is the LTR size (279.4 mm) to be conveyed on the conveying path at a predetermined sheet conveyance speed while maintaining the sheet interval (40 mm) with the following sheet. On the other hand, the output interval $T_{image}$ is calculated by summing up the image size received from the control unit 201 and the margin $\alpha$ between the images (video signals). Note that, in the following description, in the same manner as in the first embodiment, it is assumed that the output interval $T_{paper}$ and the output interval $T_{image}$ are expressed by the length. In other words, the output interval $T_{paper}$ is expressed by (sheet size (279.4 mm))+(sheet interval (40 mm)), and the output interval $T_{image}$ is expressed by (image size (350 mm))+(inter-image margin $\alpha$). Then, as illustrated in FIG. 5, (output interval $T_{paper}$)<(output interval $T_{image}$) is established, and hence an output interval $T_{image}$ (604) is set for the output interval T. Note that, the image control unit 206 instructs the CPU 204 to transmit the /TOP signal at every output interval $T_{image}$ (604 and 605), and the CPU 204 outputs /TOP signals (602 and 603) to the control unit 201.

The sheet feeding control unit 208 starts the sheet feeding operation at a predetermined timing after the CPU 204 outputs the /TOP signal (601) for the first sheet (621). Then, at a time point (631) at which the fed sheet reaches the registration sensor 35, the sheet feeding control unit 208 stops a sheet feeding motor (637), and temporarily stops the conveyance of the sheet. After that, in accordance with a timing at which the toner image formed on the intermediate transfer belt 80 is transferred onto the sheet, the sheet feeding control unit 208 restarts the sheet conveyance, and the toner image on the intermediate transfer belt 80 is transferred onto the sheet at the secondary transfer portion.

[Control Sequence of Image Formation]

Figure 6:
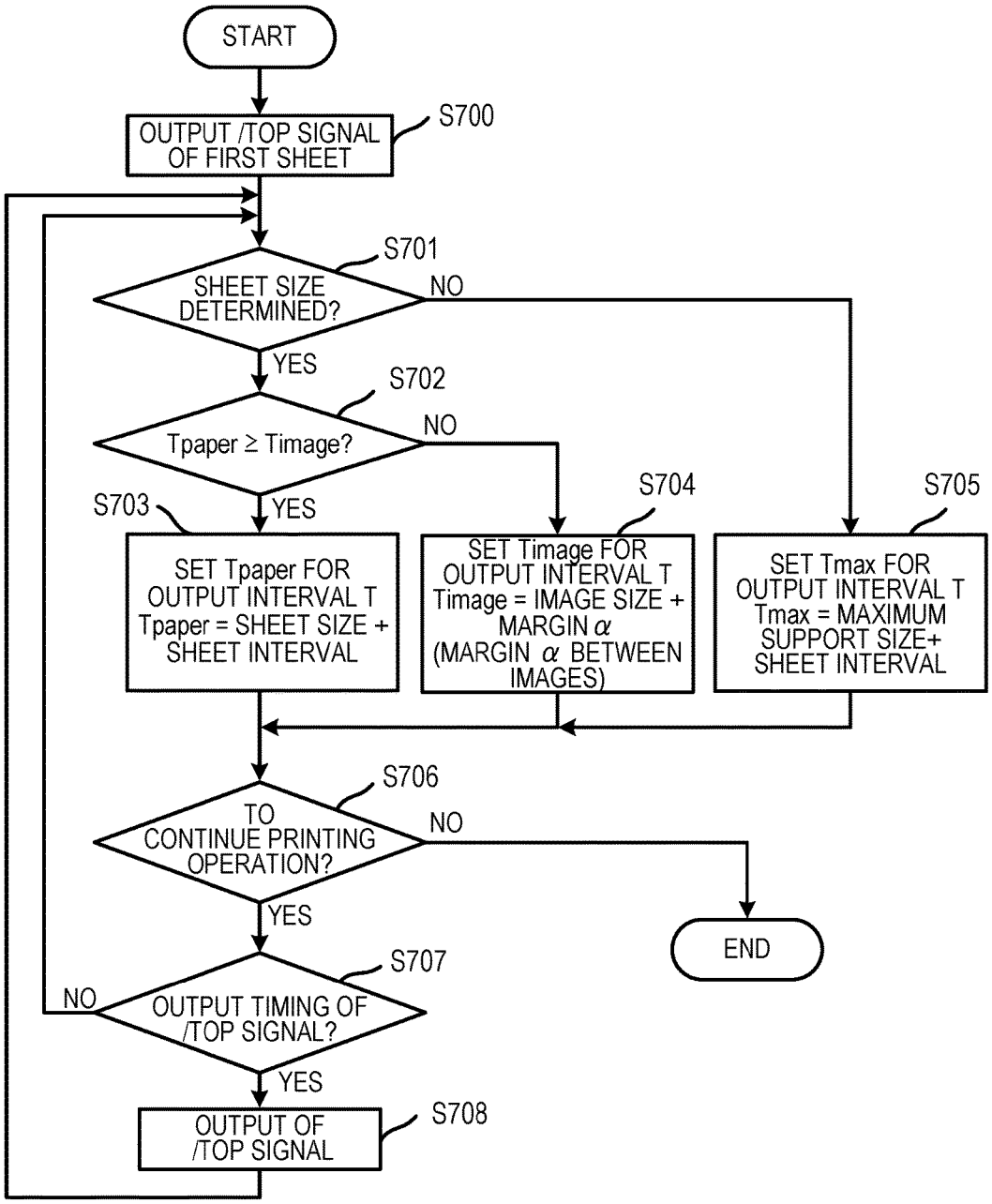
FIG. 6 illustrates a flowchart of a control sequence of the image formation according to the second embodiment.

FIG. 6 is a flowchart illustrating a control sequence for determining the output interval T of the /TOP signal and outputting the /TOP signal to the control unit 201. The processing illustrated in FIG. 6 is activated when the control unit 201 that has received the printing instruction from the host computer 200 transmits the image size information and the printing reservation command to the CPU 204 of the engine unit 202 in accordance with the printing instruction received from the host computer 200. Note that, it is assumed that the image control unit 206 has been notified of the image size information via the CPU 204 at a time point when the processing illustrated in FIG. 6 is activated.

In FIG. 6, in S700, when receiving the printing reservation command from the control unit 201, the CPU 204 prepares for executing the printing operation (printing), and waits for the transmission of the printing start command from the control unit 201. When receiving the printing start command, the CPU 204 instructs the image control unit 206, the fixing control unit 207, and the sheet feeding control unit 208 to start the printing operation in accordance with information on the printing reservation command. When receiving the instruction to start the printing operation, the image control unit 206 starts preparing for the image formation, and when completing the preparation, transmits a completion notification to the CPU 204, and resets and starts a timer configured to measure the time interval at which the /TOP signal is output. When receiving the preparation completion notification from the image control unit 206, the CPU 204 outputs the /TOP signal for the first sheet to the control unit 201 as illustrated in FIG. 5 (601).

In S701, the image control unit 206 determines whether or not the sheet size has been determined. In other words, the image control unit 206 determines whether or not the sheet size has been determined based on the presence/absence of the notification of the sheet size of the sheet conveyed along the conveying path from the sheet feeding control unit 208 and based on whether or not the sheet size has been set in the RAM (not shown) of the image control unit 206 described above. When there is no notification of the sheet size from the sheet feeding control unit 208 and when the sheet size is not set even in the RAM (not shown) of the image control unit 206, the image control unit 206 determines that the sheet size has not been determined, and advances to S705. On the other hand, when there is a notification of the sheet size from the sheet feeding control unit 208 or when the sheet size has been set in the RAM (not shown) of the image control unit 206, the image control unit 206 determines that the sheet size has been determined, and advances to S702.

In S702, the image control unit 206 calculates the output interval $T_{paper}$ of the /TOP signal based on the determined sheet size and the output interval $T_{image}$ of the /TOP signal based on the image size notified of by the control unit 201 via the CPU 204. The image control unit 206 performs the size comparison between the output interval $T_{paper}$ and the output interval $T_{image}$ that have been calculated, and when determining that (output interval $T_{image}$)≤(output interval $T_{paper}$), advances to S703. In S703, the image control unit 206 sets the output interval $T_{paper}$ based on (sheet size)+(sheet interval) for the output interval T at which the /TOP signal is output. On the other hand, when determining that (output interval $T_{image}$)>(output interval $T_{paper}$) the image control unit 206 advances to S704. In S704, the image control unit 206 sets the output interval $T_{image}$ based on (image size)+(inter-image margin α) for the output interval T for outputting the /TOP signal.

In this embodiment, the image size formed by the control unit 201 is set to 350 mm, the sheet placed in the sheet feeding unit is set to have the LTR size (279.4 mm), and the inter-image margin α is set to 5 mm. As a result, (output interval $T_{image}$(=(350 mm)+(5 mm)))>(output interval $T_{paper}$(=(279.4 mm)+(40 mm))) is established. Accordingly, in S702, the image control portion 206 determines that (output interval $T_{image}$(=(image size)+(inter-image margin α)))>(output interval $T_{paper}$(=(sheet size)+(sheet interval))), and advances to S704 to change the output interval T of the /TOP signal to 355 mm as illustrated in FIG. 5 (604).

In S705, because the sheet size is indefinite, the image control unit 206 sets the output interval $T_{max}$, which is a time period required for the sheet of the maximum support size (355.6 mm) to be conveyed while maintaining a predetermined sheet interval (40 mm), for the output interval T of the /TOP signal. Note that, the output interval $T_{max}$ is (maximum support size)+(sheet interval) when expressed by the length.

In S706, in order to determine whether or not to continue the printing operation, the image control unit 206 determines whether or not the printing start command serving as a printing instruction for the subsequent sheet has been received from the control unit 201 via the CPU 204. When determining that the printing start command has been received, the image control unit 206 advances to S707 in order to continue the printing operation, and when determining that the printing start command has not been received, determines that the printing operation is not to be continued, to bring the processing to an end.

In S707, the image control unit 206 reads a timer value from the timer started in S700, and determines whether or not the output interval T at which the /TOP signal is output has elapsed. The image control unit 206 advances to S708 when determining that the output interval T has elapsed, and returns to S701 when determining that the output interval T has not elapsed. In S708, the image control unit 206 instructs the CPU 204 to transmit the /TOP signal as illustrated in FIGS. 5 (602 and 603), and resets and restarts the timer, to return to S701.

Note that, in S702, the size comparison between the output interval $T_{paper}$ and the output interval $T_{image}$ that have been calculated is performed by the length, but the output interval may be calculated as a time period to perform the size comparison. In FIG. 6, the image control unit 206 performs the determination of the output interval T of the /TOP signal and the instruction to transmit the /TOP signal. For example, the sheet feeding control unit 208 may notify the CPU 204 of the sheet size, and the CPU 204 may perform not only the transmission of the /TOP signal but also the determination of the output interval T of the /TOP signal. Further, the sheet size used in this embodiment can be acquired by using the function of detecting the sheet size by the registration sensor 35 described in the first embodiment or an automatic sheet size detection mechanism installed in the sheet feeding unit in advance. The automatic sheet size detection mechanism serving as an acquiring unit configured to acquire the sheet size represents a configuration in which a sheet stacking unit of the sheet feeding unit is provided with a mechanism for detecting the sheet size and in which the image forming apparatus detects the sheet size automatically in advance in synchronization with a position of a regulating board that slides when the sheet is set in the sheet stacking unit, such as regulating board 50 depicted in FIG. 1. Alternatively, the automatic sheet size detection mechanism may have a configuration that allows a user to input the sheet size to be used through an operation unit (not shown) provided to the image forming apparatus, the host computer 200, or the like.

As described above, according to this embodiment, it is possible to perform the image formation normally without an overlap between the output periods of the video signals, to thereby suppress the deterioration in productivity. In this embodiment, when the output interval T of the /TOP signal is determined, in a case where the sheet size of the sheet placed in the sheet feeding unit has already been determined, the engine unit 202 determines the output interval of the /TOP signal in consideration of the sheet size and also the image size of the image to be formed by the control unit 201. With this configuration, it is further possible to suppress the deterioration in productivity and to perform the image formation normally without an overlap between the output periods of the video signals than in the first embodiment.

[Third Embodiment]

In the first embodiment and the second embodiment, the operation of the image forming apparatus performed when the printing operation for the indefinite sheet size is instructed by the host computer 200 is described. Further, the image size is described as the length (period) of the period during which the control unit 201 outputs the video signal. In a third embodiment of the present invention, an operation of the image forming apparatus performed when the printing operation for a sheet of a standard size is instructed by the host computer 200 is described. Further, the image size obtained when the standard size is designated by the control unit 201 is set as the standard size of the sheet instructed by the host computer 200 instead of the period during which the control unit 201 outputs the video signal unlike in the first embodiment or the second embodiment. In general, when the sheet of the standard size is printed, the engine unit 202 can perform the sheet conveyance and the image formation control for the standard size normally when the period during which the control unit 201 outputs the video signal in actuality is equal to or less than the standard size.

Note that, the configuration of the image forming apparatus and the system configuration thereof are the same as those of the first embodiment, and detailed descriptions thereof are omitted. Further, this embodiment is described by taking an example in which the standard size designated by the control unit 201 is set to the LGL size (sheet size: 355.6 mm) and the sheet placed in the sheet feeding unit in actuality is set to have the LTR size (sheet size: 279.4 mm). Note that, the sheet interval is set to 40 mm in the same manner as in the first embodiment and the second embodiment.

The timing chart of this embodiment is the same as FIG. 3 described in the first embodiment, and hence a description thereof is omitted. Note that, in FIG. 3 in the first embodiment, because the sheet size is indefinite, the value of the output interval $T_{max}$ (404) is set to the output interval T required for the sheet of the maximum support size to be conveyed while maintaining a predetermined sheet interval (40 mm) ((maximum support size)+(sheet interval)). In this embodiment, the value of the output interval $T_{max}$ (404) is set to an output interval $T_{fix}$ required for the sheet of the standard size (355.6 mm) designated by the control unit 201 to be conveyed while maintaining the predetermined sheet interval (40 mm) ((standard size)+(sheet interval)). In addition, this embodiment is different in that the image size is a standard size having a fixed value instead of a value that varies depending on a data amount of the image such as the output period of the video signal output by the control unit 201.

[Control Sequence of Image Formation]

Figure 7:
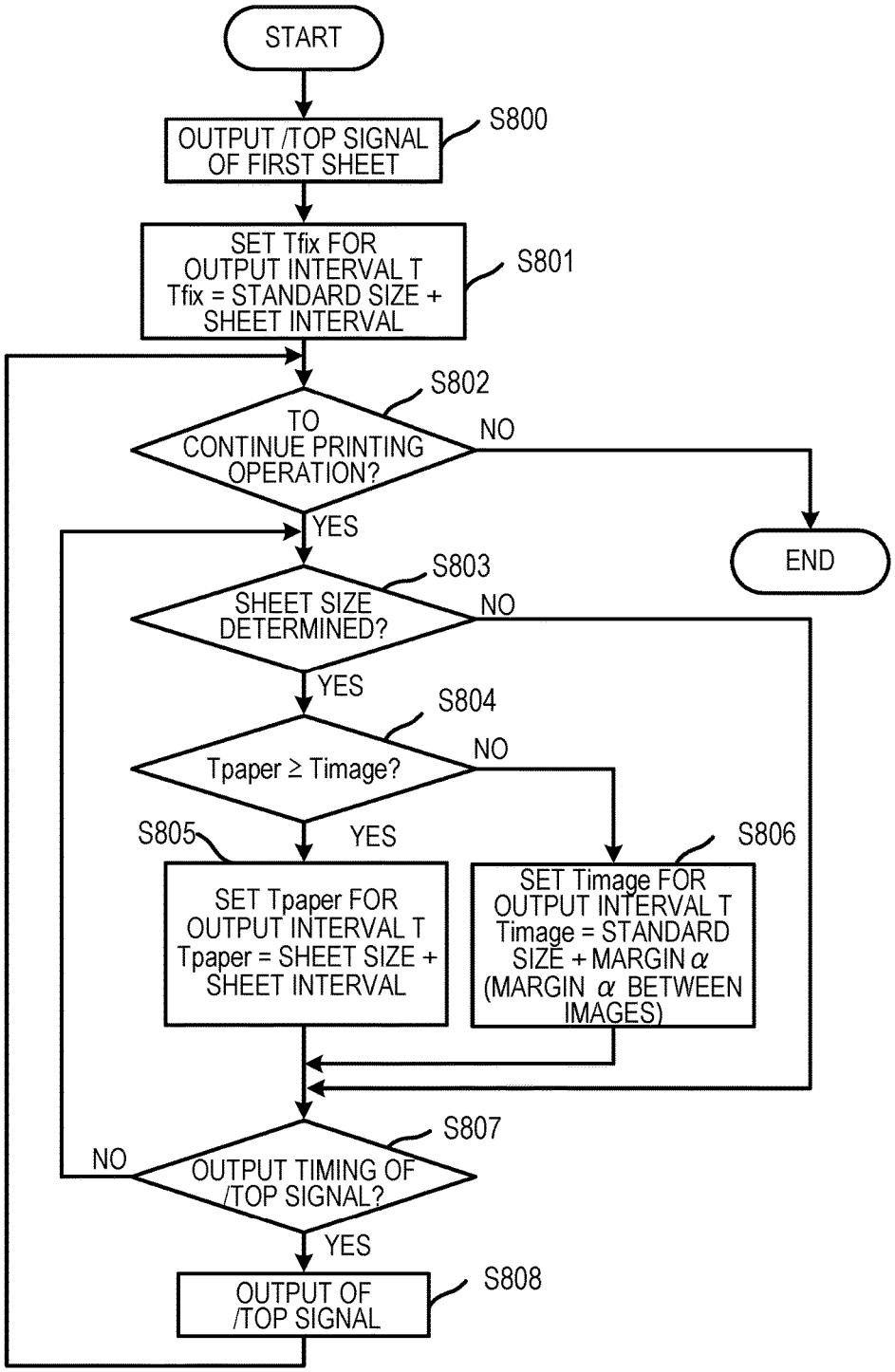
FIG. 7 illustrates a flowchart of a control sequence of image formation according to the third embodiment.

FIG. 7 is a flowchart illustrating a control sequence for determining the output interval T of the /TOP signal and outputting the /TOP signal to the control unit 201. The processing illustrated in FIG. 7 is activated when the control unit 201 that has received the printing instruction from the host computer 200 transmits the image size information and the printing reservation command to the CPU 204 of the engine unit 202 in accordance with the printing instruction received from the host computer 200. Note that, also in this embodiment, in the same manner as in FIGS. 1A to 2B, before transmitting the printing start command to the CPU 204, the control unit 201 notifies the CPU 204 of the image size (standard size in this embodiment) of the image output to the engine unit 202 by the control unit 201. Then, the CPU 204 notifies the image control unit 206 of the notified image size. After that, the control unit 201 transmits the printing start command to the CPU 204 of the engine unit 202.

The processing of S800 is the same processing as S500 of FIG. 4 in the first embodiment, and a description thereof is omitted. In S801, the image control unit 206 sets the output interval $T_{fix}$ for the output interval T of the /TOP signal based on the standard size that is the image size notified of by the control unit 201. The output interval $T_{fix}$ is the output interval required for the sheet of the standard size to be conveyed while maintaining a predetermined sheet interval, and is (standard size)+(sheet interval) when expressed by the length. In this embodiment, as described above, the standard size notified of by the control unit 201 is the LGL size (sheet length: 355.6 mm). The output interval $T_{fix}$ is (LGL size)+(sheet interval) when expressed by the length. Further, the output interval $T_{fix}$ is calculated by dividing (LGL size (355.6 mm))+(sheet interval (40 mm)) by a predetermined sheet conveyance speed.

The processing of S802 and S803 is the same processing as S502 and S503 of FIG. 4 in the first embodiment, and a description thereof is omitted. In S804, the image control unit 206 calculates the output interval $T_{paper}$ of the /TOP signal based on the determined sheet size and the output interval $T_{image}$ of the /TOP signal based on the standard size notified of by the control unit 201 via the CPU 204. The image control unit 206 performs the size comparison between the output interval $T_{paper}$ and the output interval $T_{image}$ that have been calculated, and when determining that (output interval $T_{image}$)≤(output interval $T_{paper}$), advances to S805. In S805, the image control unit 206 sets the output interval $T_{paper}$ based on (sheet size)+(sheet interval) for the output interval T at which the /TOP signal is output. On the other hand, when determining that (output interval $T_{image}$)>(output interval $T_{paper}$), the image control unit 206 advances to S806. In S806, the image control unit 206 sets the output interval $T_{image}$ based on (standard size)+(inter-image margin α) for the output interval T for outputting the /TOP signal. In this embodiment, the standard size notified of by the control unit 201 is 355.6 mm, the sheet placed in the sheet feeding unit has the LTR size (279.4 mm), and the inter-image margin α is set to 5 mm. As a result, (output interval $T_{image}$(=(355.6 mm)+(5 mm)))>(output interval $T_{paper}$(=(279.4 mm)+(40 mm))) is established. Accordingly, in S804, the image control portion 206 determines that (output interval $T_{image}$(=(image size)+(inter-image margin α)))>(output interval $T_{paper}$(=(sheet size)+(sheet interval))), and advances to S806. In S806, the image control unit 206 sets the output interval $T_{image}$ based on (standard size)+(inter-image margin α) for the output interval T of outputting the /TOP signal. The processing of S807 and S808 is the same processing as S507 and S507 of FIG. 4 in the first embodiment, and a description thereof is omitted. Note that, in FIG. 7, the image control unit 206 performs the determination of the output interval T of the /TOP signal and the instruction to transmit the /TOP signal. For example, the sheet feeding control unit 208 may notify the CPU 204 of the sheet size, and the CPU 204 may perform not only the transmission of the /TOP signal but also the determination of the output interval T of the /TOP signal.

Further, in the above-mentioned embodiments, the printing operation performed when the printing instruction including the print data (image information) and the printing conditions are received from the host computer 200 is described, but the present invention is not limited to the above-mentioned configuration. For example, in the image forming apparatus provided with a document reading apparatus and an operation panel, the above-mentioned configuration can be applied in the same manner to a case where the printing operation is performed for image data read by the document reading apparatus based on the printing conditions set through the operation panel.

As described above, according to this embodiment, it is possible to perform the image formation normally without an overlap between the output periods of the video signals, to thereby suppress the deterioration in productivity. In this embodiment, the output interval T of the /TOP signal is determined based on the standard size designated by the control unit 201 and the size of the sheet placed in the sheet feeding unit detected by the sheet feeding control unit 208. With this configuration, the engine unit 202 can suppress the deterioration in productivity even in regard to the printing operation for the sheet of the standard size, and to perform the image formation normally without an overlap between the output periods of the video signals of the same color.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-017367, filed on Jan. 31, 2014, which is hereby incorporated by reference herein in its entirety.

What is claimed is:

1. An image forming apparatus comprising:

a conveyance unit configured to convey a recording material to an image forming position;

an image forming unit configured to form an image on the recording material conveyed from the conveyance unit in response to an image signal output from an output unit;

an acquisition unit configured to acquire a length of the recording material in a conveyance direction of the recording material conveyed from the conveyance unit; and a control unit configured to determine an image forming interval between a timing at which an image signal corresponding to a preceding recording material is output from the output unit and a timing at which an image signal corresponding to a following recording material just after the preceding recording material, that is output from the output unit, based on a time interval according to an output period of the image signal corresponding to the recording material and a time interval according to the length of the recording material acquired by the acquisition unit, wherein before the acquisition unit acquires the length of the recording material, the control unit determines the image forming interval as a first interval based on a time interval according to a maximum size of the recording material among recording materials conveyed by the conveyance unit, or based on a designated size of the recording material, in a case where a size of the recording material is designated, the control unit determines the first interval based on the time interval according to the designated size of the recording material, wherein after the acquisition unit acquires the length of the recording material, the control unit determines the image forming interval as a second interval, in a case where the time interval according to the output period of the image signal corresponding to the recording material is longer than the time interval according to the length of the recording material, the control unit determines the second interval by adding the output period of the image signal corresponding to the preceding recording material into a margin period necessary for the output unit to start outputting an image signal corresponding to the following recording material, wherein the image signal is not output from the output unit during the margin period.

2. The image forming apparatus according to claim 1, wherein the acquisition unit includes a recording material detection sensor provided in a path of the recording material conveyed by the conveyance unit, wherein the acquisition unit acquires the length of the recording material based on a time period from when the recording material detection sensor detects a leading edge of the recording material to when the recording material detection sensor detects a trailing edge of the recording material, and a conveyance speed of the recording material.

3. The image forming apparatus according to claim 1, wherein the image forming unit includes an image bearing member, and a transfer unit configured to transfer the image formed on the image bearing member onto the recording material conveyed from the conveyance unit, wherein the control unit controls the image forming unit to prevent a part of the image that is outside of the recording material from being formed on the image bearing member.

4. The image forming apparatus according to claim 1, wherein in a case where a size of the recording material is not designated, the control unit determines the first interval based on the time interval according to the maximum size of the recording material among recording materials conveyed by the conveyance unit.

5. The image forming apparatus according to claim 1, wherein the margin period corresponds to a period between a timing at which the image signal for the preceding recording material is not output and which is necessary after the image signal for the preceding recording material is finished being output from the output unit, and a timing just before output of the image signal corresponding to the following recording material just after the preceding recording material.

6. The image forming apparatus according to claim 1, wherein the margin period is set based on a performance of the output unit.

* * * * *